United States Patent [19]

Gostic et al.

[11] Patent Number: 4,878,965

[45] Date of Patent: Nov. 7, 1989

[54] OXIDATION RESISTANT SUPERALLOY SINGLE CRYSTALS

[75] Inventors: William J. Gostic, Jupiter; Abdus S. Khan, Palm Beach Gardens; Kenneth S. Murphy, Juno Beach, all of Fla.

[73] Assignee: United Technologies Corporation, Hartford, Conn.

[21] Appl. No.: 105,625

[22] Filed: Oct. 5, 1987

[51] Int. Cl.[4] ..... C22C 19/05

[52] U.S. Cl. ..... 148/404; 148/410; 148/428

[58] Field of Search ..... 148/404, 410, 428; 420/445–450

[56] References Cited

U.S. PATENT DOCUMENTS 3,494,709 2/1970 Piearcey ..... 416/232
4,340,425 7/1982 Barrett et al. ..... 148/428
4,459,160 7/1984 Meetham et al. ..... 148/404

OTHER PUBLICATIONS

The Superalloys, John Wiley & Sons, 1972.

*Primary Examiner*—R. Dean
*Attorney, Agent, or Firm*—Charles E. Sohl

[57] ABSTRACT

Compositions and articles are described which have particular utility in gas turbine engine parts and which can be used at temperatures up to and in excess of 2,000° F. without the usual protective coatings. Compositions are described which can be formed into single crystal articles which are alumina formers upon exposure to oxidation and in which develop an adherent spall resistant alumina scale during oxidation. The adherence and spall resistance of the alumina surface scale results from the presence of a small but critical quantity of zirconium.

2 Claims, 1 Drawing Sheet

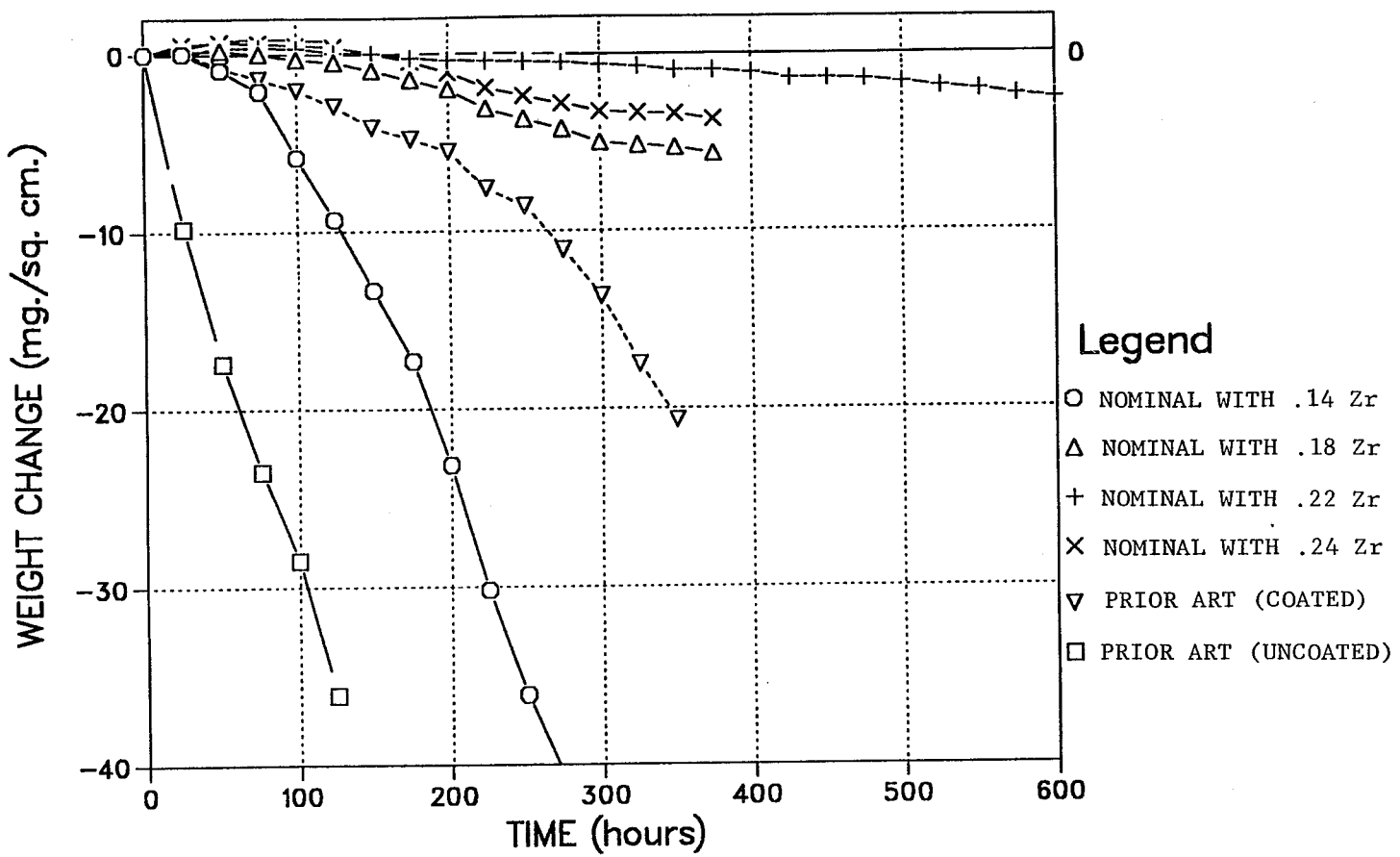
Legend
NOMINAL WITH .14 Zr
NOMINAL WITH .18 Zr
NOMINAL WITH .22 Zr
NOMINAL WITH .24 Zr
PRIOR ART (COATED)
PRIOR ART (UNCOATED)
WEIGHT CHANGE (mg./sq. cm.)
0
-10
-20
-30
-40
TIME (hours)
0
100
200
300
400
500
600

OXIDATION RESISTANT SUPERALLOY SINGLE CRYSTALS

DESCRIPTION

1. Technical Field

This invention relates to compositions which can be formed into single crystals and the resultant single crystals which have the ability to resist oxidation at temperatures on the order of 2,000° F. for extended periods of time and which can be used in gas turbine engines without protective coatings.

2. Background Art

Superalloys are materials which are usually based on nickel or cobalt and which have useful properties at temperatures on the order of 1,500° F. and above and which find wide application in gas turbine engines. As is known from U.S. Pat. Nos. 3,494,709, 4,116,723, 4,597,809 and 4,677,035 it is desirable for certain applications to form certain superalloys into single crystal articles which thereby are uniquely adapted to resist stress at elevated temperatures. The ability of superalloy single crystal articles to resist stress at elevated temperature has to date outstripped their concurrent ability to resist oxidation. For this reason, superalloy articles are invariably given protective coatings as described for example in U.S. Pat. Nos. 3,676,085, 3,928,026 and 4,585,481. Such coatings are generally not entirely beneficial since they add cost and complexity, are a weak point in oxidation resistance in the event that they are damaged and are generally thought to diminish the mechanical properties of the single crystal articles.

It has been known for some time to add so called active elements such as yttrium, lanthanum, and cerium, to superalloy coatings to improve oxidation resistance by retarding the spallation of the protective oxide which forms on the coating in service. U.S. Pat. No. 4,340,425 suggests the use of zirconium for this purpose in a specific alpha beta coating composition.

The desire to improve single crystal articles and to reduce their costs and improve their oxidation performance has led to suggestions that some of these active elements be incorporated in single crystals for purposes for improving their adherent oxidation resistance in the hopes that this might permit the use of such single crystal articles in the uncoated condition. U.S. Ser. No. 565,491 filed on Dec. 27, 1983 which is the subject of a U.S. Paent. Office Secrecy Order relates to this concept. Zirconium is not a feature of this patent.

At least one of the initial single crystal patents, (U.S. Pat. No. 3,494,709) suggests that zirconium can be present in amounts of up to 0.2%, in a specific range of alloys, but thereafter argues strongly against such additions.

It is an object of the invention to provide an improved composition for fabrication into single crystal articles. It is another object of the invention to disclose single crystal articles having greatly enhanced resistance to oxidation at elevated temperatures. Yet another object of the invention is the disclosure of well defined ranges of zirconium additions which will improve the oxidation resistance of certain superalloy in single crystal form.

These and other objects of the invention will be better understood through reference to the following disclosure of invention and brief description of drawings and detailed description of the preferred embodiments.

DISCLOSURE OF INVENTION

According to the present invention certain classes of superalloy compositions which can be formed into single crystal articles will have their resistance to oxidation greatly enhanced through the additions of small but effective amounts of zirconium, an amount on the order of from about 0.15.to about 0.30 weight percent. All percent values weight percent unless otherwise indicated.

The class of superalloys which are improved by the addition of zirconium in single crystal form are those which form alumina upon exposure to oxidizing conditions at elevated temperatures and, in oxidizing conditions at elevated temperatures and, in particular the present invention appears to have the greatest utility when applied to compositions which initially form alumina upon exposure to oxidizing conditions.

The base composition is free from intentional additions of boron which have been found to have a significant adverse effect on oxidation resistance, and contains relatively small amounts of columbium, molybdenum, titanium and tungsten which promote the formation of nonprotective nonalumina surface oxides and also contain sufficient amounts of chromium and aluminum to form alumina upon exposure to oxidizing conditions.

Preferably the base composition is free from significant amounts of cobalt, and contains intentional additions of tantalum which generally improves oxidation resistance.

The amount of zirconium added can variously be described as an amount sufficient to improve the adherence of the alumina surface layer, a small but effect amount, from about 0.15 to about 0.30% zirconium, from about 0.21 to about 0.030% zirconium, and most desirably, 0.18 to 0.24% zirconium.

The compositions according to the present invention have the significant beneficial feature of being readily castable in conventional silica bonded shell molds without excessive mold-metal reaction. This lack of reaction reduces the cost and complexity of single crystal production and ensures that the cast article contains relatively uniform amounts of zirconium levels through the article thereby ensuring uniform oxidation resistance.

The foregoing and other features and advantages of the present invention will become more apparent from the following description and accompanying drawing.

BRIEF DESCRIPTION OF DRAWING

The FIGURE illustrates the cyclic oxidation behavior of several invention alloys and two prior art samples.

BEST MODE FOR CARRYING OUT THE INVENTION

The present invention is based on the observation that the addition of small but critical amounts of zirconium to superalloy compositions substantially enhances their resistance to oxidation especially when cast in single crystal form. The addition of small amounts of zirconium is effective in enhancing the oxidation resistance of alumina forming alloys.

The oxidation of complex superalloys is an exceedingly complex phenomena, one that is not perfectly understood but one which must be empirically interpreted to some extent. It is known however that some superalloys form a protective scale of alumina while others form other types of lesser protective scale and/or mixed scales possibly containing alumina but also containing other oxide reaction products. This invention is specifically applicable to alloys which form essentially all alumina and is intended to be so limited.

Because of the complexity of superalloy oxidation, it is difficult to provide a compositional definition for alloys which will form alumina. It is clear that higher amounts of aluminum, preferably in excess of 4%, combined with amounts of chromium in excess of about 7% aid in reliable alumina formation. It is also the case that significant amounts of titanium are detrimental to the formation of alumina and therefore should be avoided. Columbium, molybdenum and tungsten are also held to low levels because they can have adverse effects.

Having said this, and with reference to Table 1 which presents the preferred compositional limits, the reliable way to determine whether an alloy is alumina forming is to fabricate it and test it under oxidizing conditions. An alloy is defined as being alumina forming if after exposure to temperatures of 2,000° F., it forms an alumina surface layer. The nature of the surface layer can be most accurately determined by X-ray analysis by techniques well known to those skilled in the art. A more expeditious approach and one that is very nearly as accurate is to judge the nature of the surface scale by the color of the scale. Alumina scales are white, light gray, or very light blue. Scales of other colors, especially darker blue color are not alumina. This technique is suggested as a screening technique which can be confirmed by X-ray analysis.

The oxidation of superalloys is complex both in the reaction of different compositions to oxidizing conditions but also in the reaction of a single composition over time. There are some alloys which will progress through various surface scales and eventually arrive at a protective alumina layer. For reasons which are not well understood, it appears that the present invention works best with alloy compositions which form alumina in the very early stages of oxidation, i.e. alloys which display all alumina surface scale after one hour exposure at 2,000° F. The invention preferably adds zirconium to such rapid initial alumina forming compositions.

Other compositional restrictions include the absence of intentional boron additions and the restriction of boron to amounts of less than about 0.01% where boron is inadvertently present as an impurity. The alloy must also contain insufficient amounts of titanium to produce a spinel type layer and preferably the amount of titanium is not greater than about 1.9%. Other compositional preferences include low cobalt contents, preferably less than about 1.9%, and intentional additions of tantalum, i.e. tantalum in excess of about 1%. These and other compositional requirements are set out in Table 1.

The composition is processed according to conventional single crystal technology and can be cast in silica bonded shell molds without significant mold metal interaction. Appropriate single crystal technology is described in U.S. Pat. Nos. 3,933,190, 4,116,723, and 4,244,551 which are incorporated herein by reference. The absence of mold metal interactions with silica bonded shell molds is a significant benefit of the present invention permitting economic and reliable production of castings having controlled amounts of zirconium to provide enhanced oxidation resistance.

Other active elements such as yttrium, cerium and lanthanum display substantial detrimental reactions with silica bonded shell molds.

The present invention may be better understood through reference to the following illustrative example.

EXAMPLE 1

A variety of single crystal articles were fabricated having varying compositions as indicated in Table 2. In Table 2 the first four alloys have as their only differences varying amounts of zirconium. The base alloy is nominally 8.9% Cr, 1.0% Mo, 6.6% Al, 9.7% W, 3.0% Ta 0.15% Hf, balance Ni with various Zr levels. The oxidation behavior of these alloys are shown in the FIG. which is a plot of weight change versus time in cyclic oxidation at 2,100° F. In the FIGURE, the optimum alloy behavior would be a zero change in weight over a long time period. Large changes in weight indicate repeated formation and spallation of an oxide layer. The repeated formation and spallation of the oxide layer leads to depletion of the alloy surface region in the oxide forming elements (e.g. aluminum), eventually to the point where the desired alumina cannot be formed. When such oxide layer is stable and non-spalling the performance tends to a horizontal line. In particular, for purposes for interpreting the present invention a weight change of less than one milligram per square centimeter in 100 hours at 2,100° F. cyclic oxidation is a highly desirable behavior and one which marks the alloy as a strong candidate for gas turbine engine use in the uncoated condition. Referring now to the FIGURE it can be seen that an alloy containing 0.14% zirconium has a weight loss of about 6 milligrams per square centimeter after 100 hours. Changing nothing but the zirconium content, from 0.14 to 0.18%, dramatically improves the oxidation resistance in that an alloy containing 0.18% zirconium shows a weight loss of less than about 0.5 milligrams per square centimeter under identical conditions, an improvement in oxidation performance of about 12X with nothing more than a very slight addition of zirconium. This data suggests a lower critical limit for zirconium between about 0.14 and about 0.18% zirconium, i.e. optimistically 0.15% zirconium or conservatively 0.18% zirconium. Increasing the zirconium from 0.14 to 0.18% to 0.22% and finally to 0.24% bring the line up to nearly the horizontal and zirconium amounts in excess of about 0.18% provide a slight increase in weight at the 100 hour point in a 2,100° F. cyclic burner rig test. Accordingly the data in this FIGURE supports the proposition that for at least for the base alloy tested that there is a critical amount of zirconium on the order of 0.15% that will provide a dramatic improvement in cyclic oxidation resistance.

The upper limit of about 0.3 wt. % zirconium is established by the incipient melting behavior of the alloy in that zirconium is a melt depressant and for many alloys will adversely lower the incipient melting point when present in amounts of much in excess of about 0.3%. Reference to the FIGURE suggests that there is no further significant benefit to be obtained by exceeding about 0.25 wt. % zirconium.

The FIG. also contains curves for two prior art samples. Both have substrates according to U.S. Pat. No. 4,209,348, (nominal composition 12% Ta, 10% Cr, 5% Co, 1.5% Ti, 4% W, 5% Al, Bal. Ni), one sample had a diffusion aluminide coating, the other was uncoated. This substrate is currently the most widely used single crystal material, the coating is also widely used. The FIGURE shows the superiority of the invention oxidation behavior to that of the prior art.

Although this invention has been shown and described with respect to detailed embodiments thereof, it will be understood by those skilled in the art that various changes in form and detail thereof may be made without departing from the spirit and scope of the claimed invention.

TABLE 1

| | Broad | Pref. | Specific Alloy |
|---|---|---|---|
| Al | 3–8 | 4–7.5 | 6.45–6.75 |
| Cr | 5–18 | 7–18 | 8–10 |
| Co | 0–10 | 0–1.9 | — |
| W | 0–15 | 0–12 | 9–10 |
| Ta | 0–12 | 1–10 | 2.75–3.25 |
| Mo | 0–4 | 0–3 | 0.8–1.2 |
| Cb | 0–2 | 0–0.5 | — |
| Re | 0–5 | 0–3 | — |
| Ti | 0–2 | 0–1.2 | — |
| C | 0–0.2 | 0–0.1 | 0–0.01 |
| B | <0.05 | <0.05 | 0–0.0025 |
| Zr | 0.15–0.30 | 0.15–0.30 | 0.18–0.25 |
| Hf | 0–1.0 | 0–0.5 | 0.1–0.2 |
| (W+Ta+Mo+Cb+Re) | >5 | 7–17 | 12.55–14.45 |
| Ni | Bal | Bal | Bal |

TABLE 1-continued

| | Broad | Pref. | Specific Alloy |
|---|---|---|---|
| Zr | | - as per text - | |

We claim:

1. A cast single crystal component consisting essentially of 2.45–6.75% Al, 8–10% Cr, 9–10% W, 2.75–3.25% Ta, 0–8–1.2% Mo, 0–0.01% C, 0–0.0025 % B, 0.18%–0.24% Zr, 0.1–0.2% Hf, 12.55%–14.45% (W+Ta+Mo+Cb+Re), bal Ni.

2. A single crystal gas turbine engine turbine blade consisting essentially of

4–7.5% Al, 7–18% Cr, 0–1.9% Co, 0–12% W, 1–10% Ta, 0–3% Mo, 0–0.5% Cb, 0–3% Re, 0–1.2% Ti, 0–0.5% C, <0.05% B, 0.15%–0.30% Zr, 0–0.5% Hf, 7–17% (W+Ta+Mo+Cb+Re), bal Ni and a small but effective amount of zirconium from about 0.21 to about 0.30% whereby, upon exposure to engine operating conditions said blade forms an adherent protective scale and is thereby made useable in uncoated form at temperatures of 2000° F. and above.

* * * * *

UNITED STATES PATENT AND TRADEMARK OFFICE

CERTIFICATE OF CORRECTION

PATENT NO. : 4,878,965

DATED : November 7, 1989

INVENTOR(S) : William J. Gostic; Abdus S. Khan; and Kenneth S. Murphy

It is certified that error appears in the above-identified patent and that said Letters Patent is hereby corrected as shown below:

In Claim 1, column 6, line 3, "2.45-6.75% Al" should read --6.45-6.75% Al--

Signed and Sealed this

Twenty-fifth Day of September, 1990

*Attest:*

HARRY F. MANBECK, JR.

*Attesting Officer*

*Commissioner of Patents and Trademarks*